United States Patent [19]

Swanborn

[11] Patent Number: 4,665,662

[45] Date of Patent: May 19, 1987

[54] METHOD AND DEVICE FOR COATING A FRONTAGE PART, OR BUILDING, WITH GLASS SHEETS

[75] Inventor: Johannes C. Swanborn, Kruis, Netherlands

[73] Assignee: Glasfabriek Sas van Gent B.V., Sas Van Gent, Netherlands

[21] Appl. No.: 746,761

[22] Filed: Jun. 20, 1985

[30] Foreign Application Priority Data

Jun. 25, 1984 [NL] Netherlands ..... 8402004

[51] Int. Cl.[4] ..... E07B 1/38

[52] U.S. Cl. ..... 52/235; 52/489; 52/509

[58] Field of Search ..... 52/235, 489, 204, 208, 52/509, 510, 202, 768

[56] References Cited

U.S. PATENT DOCUMENTS

| | | | |
|---|---|---|---|
| 2,251,991 | 8/1941 | Fellner . | |
| 2,480,241 | 8/1949 | Hensel | 52/489 X |
| 2,670,507 | 3/1954 | Daitch et al. | 52/202 |
| 4,194,333 | 3/1980 | Paton et al. | 52/235 |
| 4,370,838 | 2/1983 | Vermillion . | |
| 4,483,122 | 11/1984 | Crandell | 52/235 X |
| 4,543,755 | 10/1985 | Crandell | 52/235 |

FOREIGN PATENT DOCUMENTS

| | | |
|---|---|---|
| 1427593 | 4/1965 | France . |
| 14864245 | 5/1966 | France . |
| 20163575 | 5/1970 | France . |

*Primary Examiner*—Carl D. Friedman

*Attorney, Agent, or Firm*—Birch, Stewart, Kolasch & Birch

[57] ABSTRACT

A method and a device for providing a frontage part (1) with glass sheet (2) to which a supporting means (20) is secured, in which the glass sheet (2) is arranged on hooks (3) provided on the frontage (1) and thereupon locking means (22) which are previously arranged on the frontage part (1) are moved to their locking position.

14 Claims, 12 Drawing Figures

Figure 1:
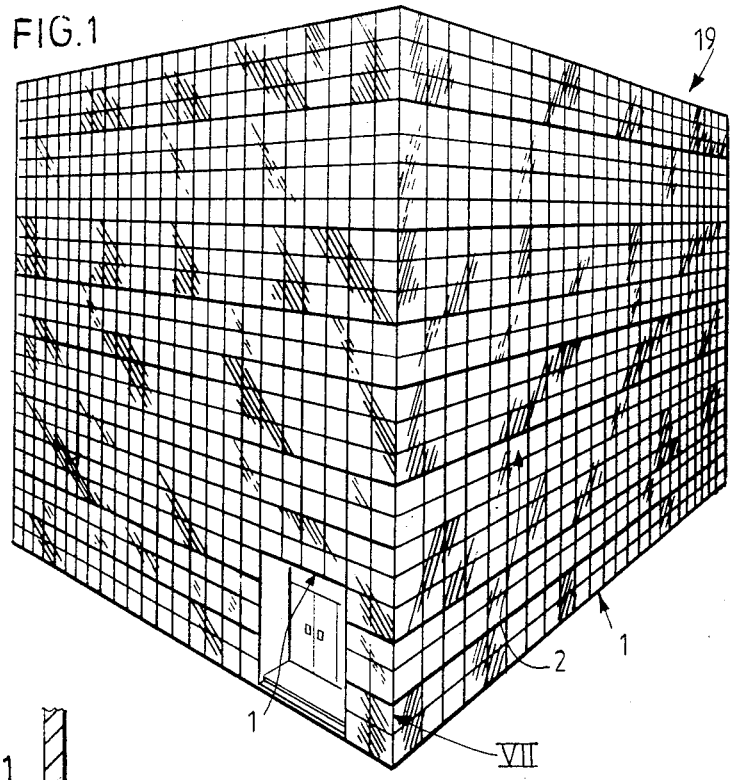

FIG. 7
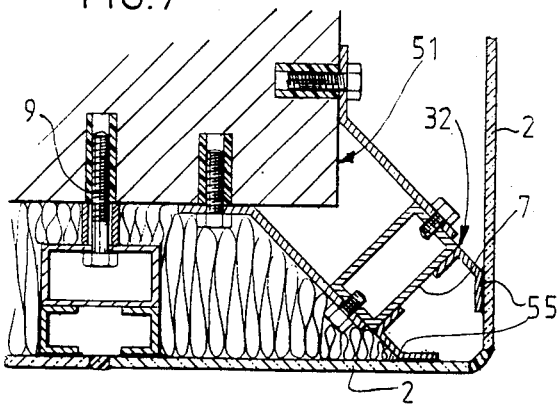
FIG. 8
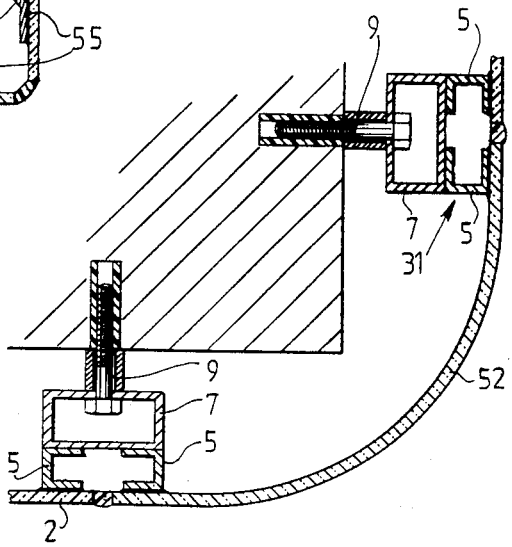
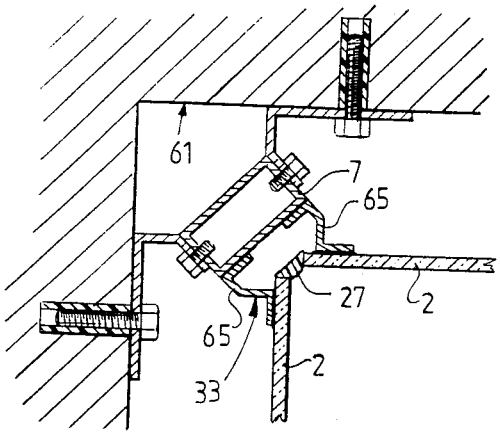
FIG. 9
FIG. 10
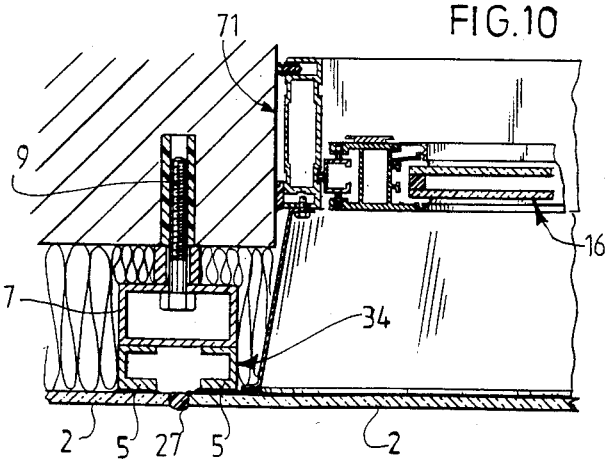

METHOD AND DEVICE FOR COATING A FRONTAGE PART, OR BUILDING, WITH GLASS SHEETS

The invention relates to a method of coating a frontage part, or building with glass sheets, in which each glass sheet provided with supporting means is secured to the frontage part by means of fastening means engaging the supporting means.

Such a method is known from French patent specification No. 2.016.357 in which a glass sheet unit is provided with a supporting frame and in which a complicated device is described for turning the glass sheet unit on a frontage part about a hinge. The disadvantage of this device is that a supporting frame is required so that there will not be formed an uninterrupted glass wall and that a hinge with the associated complex supporting and fastening means is necessary for establishing a vertical position of the glass sheet unit.

The object of the invention is to provide a simple method for aesthetically covering a frontage part, in which simple means need be arranged on glass sheets and a frontage part.

To this end the method embodying the invention is characterized in that the supporting means comprise two profiles or U-shaped beams each provided with two flanges parallel to the glass sheet, one flange being fastened by means of a glue layer previously applied to the glass sheet. To mount a glass sheet, the profiles arranged at the lower end of the glass sheet are disposed to engage previously arranged hooks on the frontage part behind upwardly directed hook heads thereof and subsequently displaceable locking means previously arranged on the frontage part are moved into their locking position in which they engage the other ends of the flanges of the profiles of the glass sheet in a locking manner.

It is noted that in itself the disposition of panels on hook-shaped members is known from U.S. Pat. No. 2,251,991, in which, however, the panels are not metal enamelled panels and are provided with slots in which displaceable locking means are engaged. Since it is practically not possible to provide glass sheets with slots, this method cannot be used for coating a frontage part with glass sheets. Locking means are also known from U.S. Pat. No. 4,370,838. the purpose therein is the renovation of existing inner walls of a building and thus not to apply glass sheets. Moreover, in this case there is not the problem of a high building or frontage, since the panels can be simply placed in rails.

The invention furthermore provides a device for coating a glass sheet on a frontage part comprising supporting means fastened to the glass sheets and fastening means engaging the supporting means characterized in that the supporting means comprise two profiles or U-shaped beams each having adjacent parallel flanges, one flange being fastened by means of a glue layer previously applied to the glass sheet, the fastening means comprise hooks secured to the frontage part, the hook heads being upwardly directed and engaging behind the supporting means and in that the fastening means comprise displaceable locking means arranged on the frontage part and being displaceable into a locking position, in which the locking means engage the other profile end in a locking manner.

Preferably the hook heads are inclined upwardly from the frontage part, since with the hook heads inclined upwardly from the frontage part guide the glass sheets from top to bottom into the position in which they coat the frontage part.

The above-mentioned and further features of the invention will be elucidated in the following description with reference to a drawing.

Figure 11:
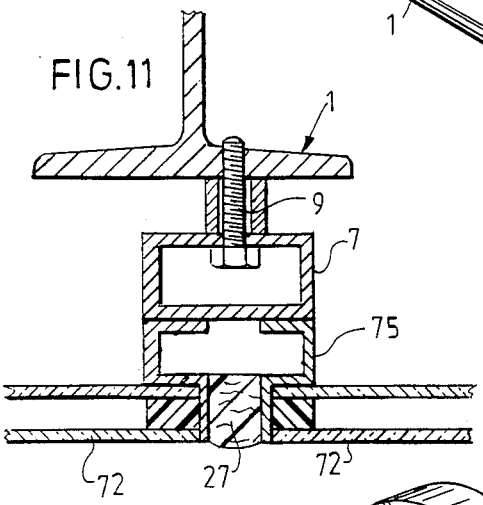
Figure 12:
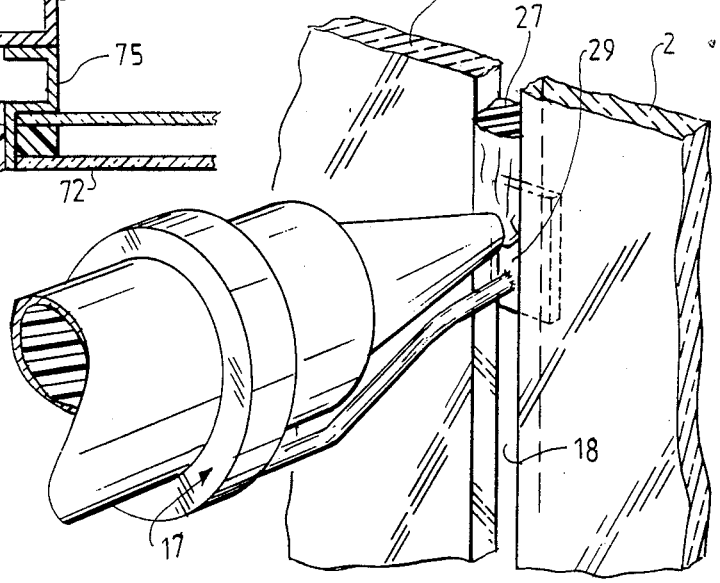
Figure 2:
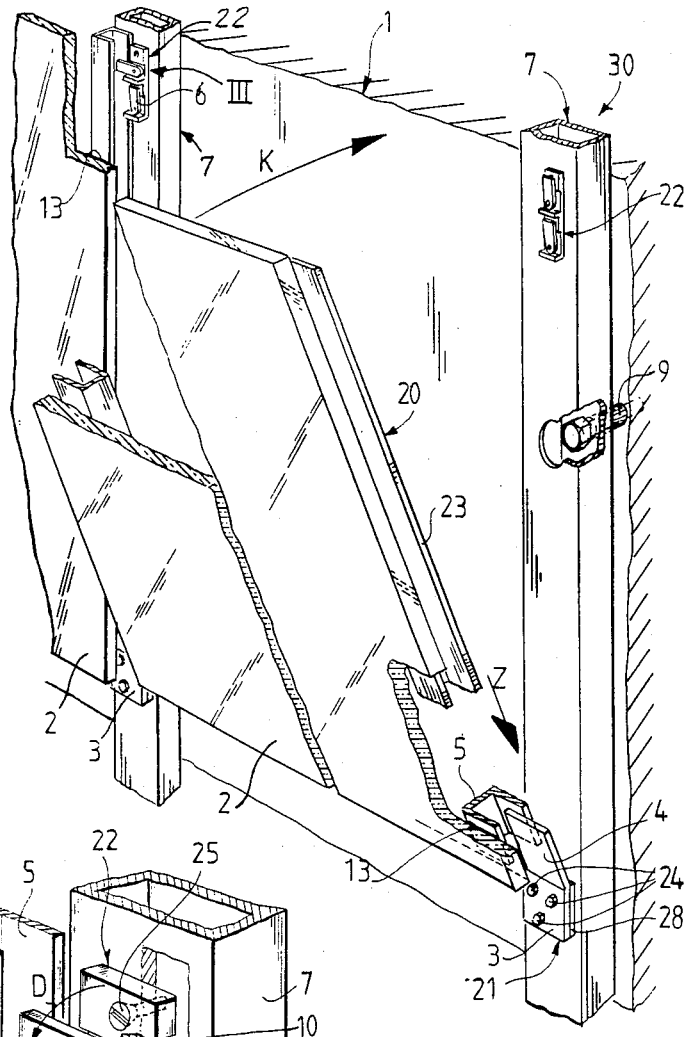
Figure 3:
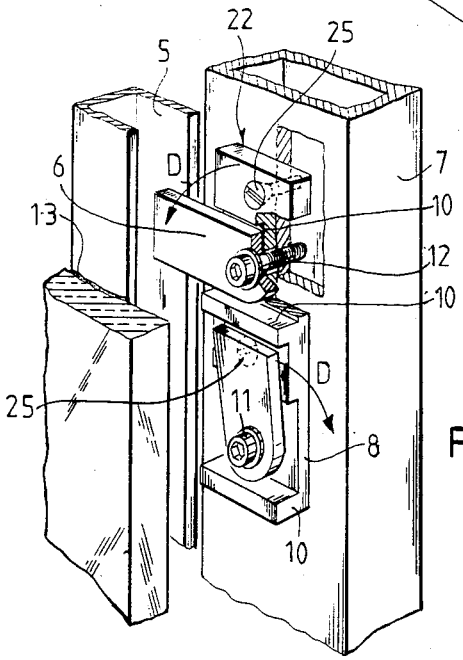
Figure 4:
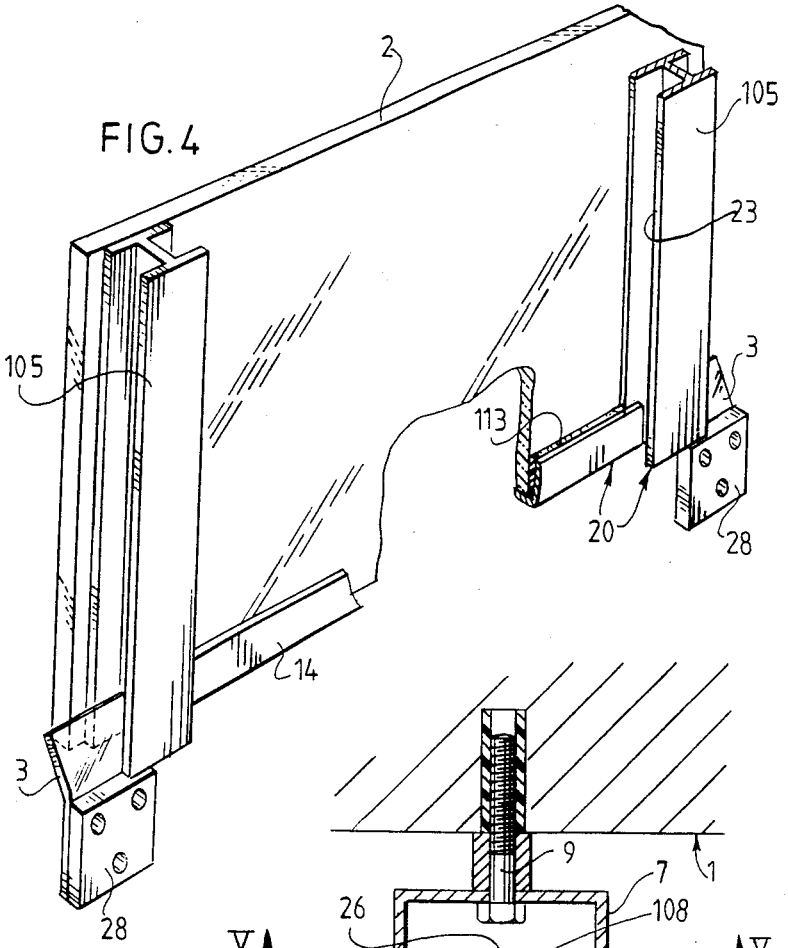
Figure 6:
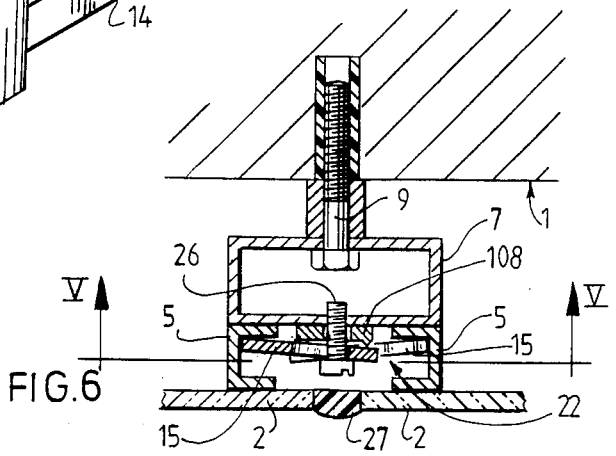
Figure 5:
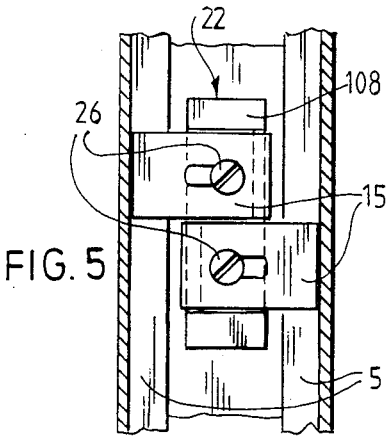

The drawing schematically represents in:

FIG. 1 a perspective view of frontages or a building coated with glass sheets using the method embodying the invention, FIG. 2 a fragmentary, perspective view of a frontage with a glass sheet during the execution of the method embodying the invention, FIG. 3 an enlarged, perspective view of detail III of FIG. 2, FIG. 4 a fragmentary, perspective view of a variant of the glass sheet that can be fastened in accordance with the invention, FIGS. 5 and 6 a front view and a plan view respectively of an alternative embodiment of the lock bolts, FIGS. 7 to 11 each a horizontal sectional view of a different frontage part with a device embodying the invention, FIG. 12 a perspective view of the activity of sealing the gap between two neighbouring glass sheets.

Frontage parts 1 are coated with glass sheets 2, for example, as outer walls of a building 19 (FIG. 1).

In the device 30 embodying the invention (FIG. 2) on the frontage parts 1 metal hollow profiles or beams 7 are fastened by means of screws 9. Before the hollow profiles 7 are arranged on the frontage part 1, fastening means 21 and locking means 22 are provided thereon. The fastening means 21 comprise hooks 3 having hook heads 4 inclined upwardly from the frontage part 1. A hook 3 is fixed to the profile 7 by means of screws 24 passing through a plate 28. Supporting means 20 are arranged previously preferably by means of a glue layer 13 on the glass sheets 2. Preferably the supporting means 20 comprise vertical, U-shaped profiles or beams 5 of metal extending along substantially the whole length of the glass sheet 2, whilst their flange substantially parallel to the glass sheet engages at the lower end of the glass sheet 2 on the hooks 3 behind hook heads 4 in lowering the glass sheet 2 in the direction of the arrow Z. Subsequently the glass sheet 2 can be tiled in the direction of the arrow K until this glass sheet 2 is approximately in its vertical position.

The locking means 22 also previously arranged on the profiles 7 preferably comprise (FIG. 3) lock bolts 6 rotatable in the direction of the arrow D when the U-shaped profiles or beams 5 fastened to the glass sheets in their vertical position are approximately near the hollow profiles or beams 7. The lock bolts 6 are held in their locking positin by stops 10. Preferably the lock bolts 6 are arranged pairwise on a carrier 8 so that each of them can lock a glass sheet. The carrier 8 is fastened by screws 25 to the profile 7. The lock bolts 6 are furthermore held by means of screws 11 in the profiles 7 cooperating with spring rings 12 arranged between the lock bolts 6 and the profiles 7.

The variant shown in FIG. 4 comprises other supporting means 20 for the glass sheet 2, which comprise I-shaped metal profiles or beams 105 engaging the hooks 3 and a supporting rim 14 fastened by means of a glue layer 113 to the underside of the glass sheet 2 and to the I-beams 105.

In a further embodiment illustrated in FIGS. 6 and 7 for the locking means 22 sliding lock bolts 15 fasten the profiles 5 to glass sheets in a locking manner on the profiles 7 fastened by screws 9 on the frontage part 1. The lock bolts 15 are furthermore arranged pairwise by means of screws 26 on a carrier 108.

Embodiments of devices 31, 32, 33 in accordance with the invention for coating frontage parts 51, 61 having a rectangular corner either use glass sheets 52 (FIG. 8) of quarter-cylindrical shape for which the profiles 5, 7 can be utilised or alternative profiles 55, 65 are required for supporting the glass sheets 2 for securing the glass sheets 2 to the frontage parts 51, 61 via the profiles 7 (FIGS. 7 and 9). Receding frontage parts 71 having, for example, a sliding window 16 can also be coated in a simple manner with glass sheets 2 by means of the profiles 5, 7 (FIG. 10).

As shown in FIG. 11 the device 34 embodying the invention can also be used for coating a frontage part 1 with double glass sheets 72. The profiles 75 required for supporting the double glass sheets 72 may have the shape of a G. These profiles 75 are secured to the profiles 7 by means of the fastening means 21 described above and the locking means 22.

After the glass sheets 2, 72 are arranged on the frontage parts 1 a board 29 positioned behind the intermediate space 18 between two glass sheets 2, 72 is each time provided with a strip of silicon-like substance 27 by means of a spout 17 for sealing the coating of the frontage part 1.

What we claim is:

1. A device (30) for coating a frontage part (1) with glass sheets (2) comprising supporting means (20) fastened to said glass sheets (2) and fastening means (21) engaging said supporting means (20) and secured to said frontage part (1), characterized in that each said supporting means (20) comprise two vertically directed profiles (5, 105), each said profile having two flanges parallel to said glass sheet (2), one said flange being previously fastened to said glass sheet by means of a glue layer (13), said fastening means (21) comprise hooks (3) fastened to said frontage part (1) and having hook heads (4), said hook heads (4) are directed upwardly, said profiles (5, 105) bear on said hooks (3) and engage behind said hook heads (4) and said fastening means (21) comprise displaceable means (22) arranged on said frontage part (1) which are movable into a locking position, in which said displaceable means (22) engage the other one of said flanges (23) of said profiles (5, 105) in a locking manner.

2. A device (30) as claimed in claim 1, characterized in that said hook heads (4) are inclined upwardly from said frontage part (1).

3. A device (30) as claimed in claim 2, characterized in that said displaceable locking means (22) can be turned into their locking position.

4. A device (30) as claimed in claim 2, characterized in that said displaceable means comprise at least two lock bolts (6) for two neighboring glass sheets (2) mounted on a common carrier (8).

5. A device (30) as claimed in claim 2, characterized in that said fastening means (21) and said displaceable locking means (22) are arranged on metal profiles (7) secured to said frontage part (1).

6. A device (30) as claimed in claim 1, characterized in that said displaceable locking means (22) can be turned into their locking position.

7. A device as claimed in claim 6, characterized in that said displaceable locking means (22) comprise a lock bolt (6) which is guarded by at least one stop in its locking position.

8. A device (30) as claimed in claim 7, characterized in that said displaceable means comprise at least two lock bolts (6) for two neighboring glass sheets (2) mounted on a common carrier (8).

9. A device (30) as claimed in claim 7, characterized in that said fastening means (21) and said displaceable locking means (22) are arranged on metal profiles (7) secured to said frontage part (1).

10. A device (30) as claimed in claim 6, characterized in that said displaceable means comprise at least two lock bolts (6) for two neighboring glass sheets (2) mounted on a common carrier (8).

11. A device (30) as claimed in claim 6, characterized in that said fastening means (21) and said displaceable locking means 22 are arranged on metal profiles (7) secured to said frontage part (1).

12. A device (30) as claimed in claim 1, characterized in that said displaceable means comprise at least two lock bolts (6) for two neighbouring glass sheets (2) mounted on a common carrier (8).

13. A device (30) as claimed in claim 12, characterized in that said fastening means (21) and said displaceable locking means (22) are arranged on metal profiles (7) secured to said frontage part (1).

14. A device (30) as claimed in claim 1, characterized in that said fastening means (21) and said displaceable locking means (22) are arranged on metal profiles (7) secured to said frontage part (1).

* * * * *